US006533076B1

(12) United States Patent
Haverfield et al.

(10) Patent No.: US 6,533,076 B1
(45) Date of Patent: Mar. 18, 2003

(54) MATERIALS HANDLING VEHICLE MAST HEIGHT SENSOR

(75) Inventors: Forrest A. Haverfield, Maplewood, OH (US); Allen T. Trego, Hampshire, IL (US)

(73) Assignee: Crown Equipment Corporation, New Bremen, OH (US)

( * ) Notice: Subject to any disclaimer, the term of this patent is extended or adjusted under 35 U.S.C. 154(b) by 0 days.

(21) Appl. No.: 10/068,709

(22) Filed: Feb. 6, 2002

(51) Int. Cl.[7] ..... B66B 3/00

(52) U.S. Cl. ..... 187/394; 187/222; 414/273; 414/635

(58) Field of Search ..... 187/391–394, 187/399, 222, 224; 414/266, 270, 273, 281–285, 635, 630, 631, 636; 364/478.1, 479.14

(56) References Cited

U.S. PATENT DOCUMENTS

| | | | | |
|---|---|---|---|---|
| 2,134,025 | A | | 10/1938 | Bredouw |
| 3,319,816 | A | | 5/1967 | Christenson |
| 3,572,484 | A | | 3/1971 | Richins |
| 3,589,535 | A | | 6/1971 | Reading |
| 3,811,192 | A | | 5/1974 | Christensen |
| 3,812,589 | A | | 5/1974 | Schultheis |
| 3,816,003 | A | | 6/1974 | Litke |
| 3,936,943 | A | | 2/1976 | Bullard, III |
| 3,955,073 | A | | 5/1976 | Carew et al. |
| 4,074,794 | A | | 2/1978 | Scholl |
| 4,108,282 | A | | 8/1978 | Satoh et al. |
| 4,122,957 | A | | 10/1978 | Allen et al. |
| 4,210,865 | A | | 7/1980 | Nikolaev et al. |
| 4,259,637 | A | | 3/1981 | Bloomfield et al. |
| 4,266,215 | A | | 5/1981 | Adams |
| 4,300,039 | A | | 11/1981 | Avins |
| 4,411,582 | A | | 10/1983 | Nakada |
| 4,443,888 | A | | 4/1984 | Cutter |
| 4,472,713 | A | | 9/1984 | Breslow |
| 4,499,541 | A | | 2/1985 | Yuki et al. |
| 4,509,127 | A | | 4/1985 | Yuki et al. |
| 4,511,974 | A | | 4/1985 | Nakane et al. |
| 4,547,844 | A | | 10/1985 | Adams |
| 4,598,797 | A | | 7/1986 | Schultz |
| 4,646,085 | A | | 2/1987 | Mathis |
| 4,697,144 | A | | 9/1987 | Howbrook |
| 4,747,215 | A | | 5/1988 | Waikas |
| 4,757,244 | A | | 7/1988 | Iwamoto et al. |
| 4,879,508 | A | | 11/1989 | Andermo |
| 4,882,536 | A | | 11/1989 | Meyer |
| 4,924,151 | A | * | 5/1990 | D'Aleo et al. ..... 315/295 |
| 5,011,358 | A | | 4/1991 | Andersen et al. |
| 5,022,496 | A | | 6/1991 | Klopfleisch et al. |
| 5,103,226 | A | | 4/1992 | Dammeyer et al. |
| 5,274,203 | A | * | 12/1993 | Skalski et al. ..... 187/393 |
| 5,687,081 | A | | 11/1997 | Wellman et al. |
| 5,749,696 | A | | 5/1998 | Johnson |
| 5,761,822 | A | | 6/1998 | Steinich |
| 6,002,250 | A | | 12/1999 | Masreliez et al. |
| 6,011,389 | A | | 1/2000 | Masreliez et al. |
| 6,269,913 | B1 | | 8/2001 | Kollmannsberger et al. |
| 2001/0035315 | A1 | * | 11/2001 | Lindegger et al. ..... 187/391 |

FOREIGN PATENT DOCUMENTS

| | | |
|---|---|---|
| EP | 0 335 196 A1 | 10/1989 |
| GB | 2 156 099 A | 3/1984 |

* cited by examiner

*Primary Examiner*—Jonathan Salata
(74) *Attorney, Agent, or Firm*—Stevens & Showalter, LLP

(57) ABSTRACT

A knurled wheel is coupled to a sensor mounted to one mast member and the wheel is forced into another mast member so that the wheel/sensor rotate upon mast movement. The sensor generates signals, corresponding to mast movement, which are processed conventionally to determine mast height, etc. The knurled wheel forms a track on the contacted mast member and the knurl engages the track. The wheel can be forced into the mast member with a force of six to nine pounds. To enhance the versatility of the mast height sensing device, the thickness of the wheel can be made less than 1/8 inch, for example 1/16 inch. The sensor can be an encoder or a sensor bearing and a heater can be provided for operation in cold environments to ensure rotation of the sensor under such conditions.

29 Claims, 4 Drawing Sheets

MATERIALS HANDLING VEHICLE MAST HEIGHT SENSOR

BACKGROUND OF THE INVENTION

The present invention relates in general to materials handling vehicles and, more particularly, to a device for monitoring movement of mast elements of such vehicles so that the height of a mast, an associated load lifting device, an operator's platform or the like can be determined.

The importance of determining the height of masts, load lifting devices, such as forks, operator's platforms and the like, generally referred to herein as "mast height", is well known in the art. Known mast height sensing or measuring devices have taken a wide variety of forms.

For example, a float actuated potentiometer monitoring the liquid level in a sump tank of a hydraulic system controlling mast extension to determine mast height is disclosed in U.S. Pat. No. 4,598,797.

A disc coupled to a chain wheel used for controlling a mast and having a plurality of slits which pass through a light emitting/detecting path with resulting pulse signals being counted to determine mast height is disclosed in U.S. Pat. No. 4,499,541.

In EP 0 335 196 A1, a gear coupled to a resolver mounted on a stationary upright of a mast assembly is driven by a ladder assembly mounted on a movable upright of the mast assembly and having rungs or teeth engaging and rotating the gear so that the resolver generates a signal representative of mast height.

The height and speed of a carriage elevated by a screw lift is monitored by a rotary encoder that senses rotary angular displacement of the screw in U.S. Pat. No. 4,782,920.

In U.S. Pat. No. 5,022,496, the extension and retraction of a cable wound on a spring biased take-up reel mounted on a platform assembly of a turret stockpicker activates an encoder that produces output pulses in direct relation to the amount of rotation of the reel so that the vertical position of the platform assembly can be determined by a microcomputer receiving the pulses.

In U.S. Pat. No. 3,319,816, direction and distance of movement of a moving mast member of a lift truck relative to a fixed mast member of the truck is measured using a transducer secured to the fixed mast member. The transducer includes a potentiometer that is rotated through a gear train extending between the potentiometer and a friction wheel that engages and is rotated by movement of the moving mast member.

In GB 2 156 099A, a mast height sensor is disclosed wherein a rotary shaft encoder is driven by a wheel having a rubber tire mounted thereon that is spring biased against a mast member so that the wheel and hence the shaft of the encoder are rotated by relative movement between the mast members. The encoder generates pulses for predetermined degrees of rotation in either direction and by counting these pulses up and down a measure of mast/platform height is derived.

In U.S. Pat. No. 6,269,913 B1, a mast height sensor uses a roller bearing with a built in sensor for determining the speed and/or relative displacement of the outer race of the bearing relative to the inner race of the bearing. The inner race of the bearing is fixed to a first mast member and the outer race is elastically preloaded against a second mast member to serve as a roller body as the mast members move relative to one another. Rotation of the outer race relative to the inner race is monitored using signals generated by the built-in sensor which signals are counted and used in a conventional quadrature direction sensing arrangement to determine direction of movement, mast height and speed of mast movement.

Unfortunately, many of these mast height sensors lack the accuracy required for modern day materials handling vehicle operating systems. Others do not hold up under operating conditions encountered by many materials handling vehicles. Still others do not operate properly when they encounter severe operating conditions. For example, mast height sensor problems have been experienced when materials handling vehicles are operated in big freezers in food warehouses that can be operated at temperatures as low as −40° F. (−40° C.). Even if a sensor can tolerate such cold temperatures, the vehicles move from the freezers to warmer rooms and/or outside so that condensation forms on the sensors and mast assemblies with the condensation often being in the form of ice. Such operating conditions are a particular problem for mast height sensors that rely on frictional engagement of a rotating member, such as a rubber covered wheel or an outer race of a bearing sensor, since moisture and ice reduce the friction necessary for their operation. Thus, frictional contacts that may work perfectly well in normal room and warehouse temperatures, fail when operated in and around freezers. Thus, there is a need for an improved mast height sensor for materials handling vehicles that can operate not only under normal operating conditions but also in adverse conditions such as those encountered in and around freezers.

SUMMARY OF THE INVENTION

This need is met by the invention of the present application wherein a knurled wheel is coupled to a sensor mounted to one of at least two mast members and the wheel is forced into contact with another mast member so that the wheel is rotated when the mast members are moved relative to one another. Rotation of the wheel causes the sensor to generate signals corresponding to the movement of the mast members. The signals generated by the sensor are processed conventionally to determine mast height, direction of movement of one or more of the mast members, speed of movement of one or more of the mast members and acceleration of one or more of the mast members, as needed. The knurled outer periphery of the wheel is forced into the mast member that it contacts with sufficient force so that a track corresponding to the knurl on the wheel is formed in the contacted mast member and the knurl engages the track for better traction. In a working embodiment of the invention, the wheel was forced into the contacted mast member with a force of six to nine pounds. To enhance the versatility of the mast height sensing device of the present application, the thickness of the wheel can be made less than ⅛ inch, for example 1/16 inch. Use of a thin wheel enhances operation of the mast height sensor in cold environments, such as food freezers of warehouses where ice may form on the contacted mast member. The sensor can be an encoder or a sensor bearing and a heater can be provided for operation in cold environments to ensure rotation of the sensor under such conditions.

A variety of features and advantages of the invention will be apparent from the following description, the accompanying drawings and the appended claims.

BRIEF DESCRIPTION OF THE INVENTION

DETAILED DESCRIPTION OF THE INVENTION

Figure 1:
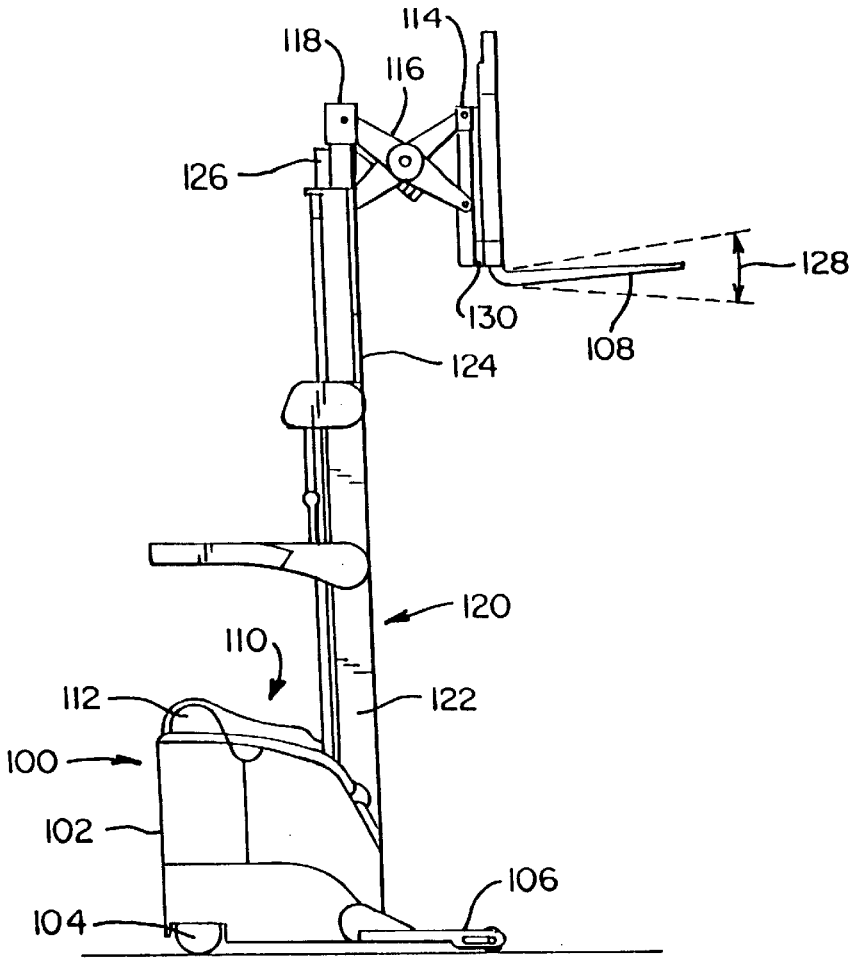
FIG. 1 illustrates a rider reach lift truck wherein the mast height sensing device of the present application can be used.

While the mast height sensor of the present application can be used in any materials handling vehicle wherein the height of masts, load lifting devices, such as forks, operator's platforms and the like (generally referred to herein as "mast height") is to be determined, it will be described with reference to a rider reach lift truck 100 illustrated in FIG. 1. The rider reach lift truck 100 includes a power unit 102 which houses a battery for supplying power to a traction motor connected to a steerable wheel and to hydraulic motors which supply power to several different systems including a mast lifting system. A caster wheel 104 is mounted at the right rear of the truck 100 while a pair of outriggers 106 are mounted at the forward part of the truck 100.

The direction of travel and the travel speed of the truck 100 and height, extension, tilt and side shift of forks 108 are controlled from an operator's compartment 110 in the power unit 102. A back rest or seat 112 supports the operator in the compartment 110. The forks 108 are mounted on a fork carriage mechanism 114 which is in turn mounted on a reach mechanism 116 on a vertical carriage assembly 118. The assembly 118 is attached to an extensible mast assembly 120, which includes a fixed, lower mast member 122 and nested movable mast members 124 and 126 which may be made from SAE V-1027 grade of steel. A hydraulic cylinder (not shown) is operated to control mast height and thereby the height of the forks 108 which are shown raised in FIG. 1. The forks 108 may be tilted through a range shown by the arrow 128 by means of a hydraulic cylinder 130 located between the forks 108 and the fork carriage mechanism 114. The forks 108 may also be moved from side to side by a side shift mechanism.

To measure the relative direction and distance of movement of the mast members 124, 126, a mast height sensing device 150, shown in FIGS. 2–5, is mounted to the lower mast member 122 and includes a wheel 151 that is forced into the mast member 124 and rotates as the mast member 124 moves relative to the lower mast member 122. The mast sensing device 150 comprises a bracket 152 that is used to mount the mast height sensing device to the lower mast member 122. An arm 154 is fixed to a shaft 156 mounted for pivotal movement to the bracket 152. A spring 158 surrounding the shaft 156 is coupled between the bracket 152 and the arm 154 to spring bias the arm 154 away from the bracket 152. Ideally, the spring 158 would provide a constant force over the range of movement of the arm 154 when the mast height sensing device 150 is installed in the truck 100. Toward that end, the spring 158 is made as long as possible for the available mounting space for the mast height sensing device 150. If desired, the mast height sensing device 150 can be mounted to a moving mast member so that the wheel 151 of the device is forced into a fixed or other moving mast member. For example, the mast height sensing device 150 can be mounted to the mast member 124 with the wheel 151 engaging the lower mast member 122 or the mast member 126.

A sensor bearing 160 has a fixed outer race 160A, secured to the arm 154 by a retainer 162 and a gasket 164, and a rotating inner race 160B. Sensor bearings (well known in the art, see U.S. Pat. No. 4,259,637, and commercially available, for example, from SKF USA, Inc.) combine bearings including ball bearings, taper bearings and cylindrical bearings, with integrated sensors that detect rotational movement of the inner race 160B relative to the outer race 160A. The sensor generates quadrature output signals that enable an associated circuit or properly programmed computer to determine not only the amount of rotation but also the direction of rotation of the sensor as is well known in the art, for examples of this use of quadrature signals see U.S. Pat. Nos. 4,300,039 and 4,982,189 which are incorporated herein by reference. The sensor bearing 160 can be replaced by an appropriate shaft encoder as should be apparent to those skilled in the art, see also GB 2 156 099A which is incorporated herein by reference. If a shaft encoder is used in place of the sensor bearing 160, the wheel 151 would be attached to the shaft of the shaft encoder. To ensure proper operation of the mast height sensor 150 in cold environments, a heating element H and heating element cover HC may also be incorporated into the sensor 150, see FIG. 3. In a working embodiment of the mast height sensor 150, a 7.50 watts silicon rubber heater commercially available from Heatron Inc. was conformed and secured to the sensor bearing 160 using a pressure sensitive adhesive.

The wheel 151 includes a hub 151H that is used to secure the wheel 151 to the inner race 160B by means of a washer 166 and a screw 168. The wheel 151 may be made of steel, for example AISI 1144 steel, with a thin, for example 0.0005/0.0007 inch, nickel high phosphorus plating for corrosion resistance. The outer periphery 151A of the wheel 151 is knurled, for example a raised point diamond knurl with a 90° tooth angle and 16 teeth per inch can be used. The knurl is induction hardened to a Rockwell C hardness of Rc 55-60 to a depth of 0.040±0.010 inch. The knurl can be formed by high pressure metal working, machining, etching or any other appropriate metal forming/processing techniques.

A variety of wheel thicknesses are contemplated for use in the mast height sensing device of the present application with the thickness of the wheel depending, at least in part, upon the knurl selected for the wheel. However, applicants have determined that performance of a mast height sensor is enhanced if the thickness of the wheel is less than around ⅛ inch. Use of such a thin wheel particularly enhances operation of the mast height sensor 150 in cold environments, such as food freezers of warehouses where ice may form on the mast member contacted by the wheel 151. For wheels using the identified knurl and having a thickness greater than around ⅛ inch, ice tends to build up in the knurl and lead to inaccurate and ineffective operation when used on ice covered mast members. In a working embodiment of the mast height sensor 150, a wheel thickness that is approximately 1⁄16 inch has proven to be very effective during operation in conventional warehouse conditions as well as the extreme conditions encountered in big freezers in food warehouses that can be operated at temperatures as low as −40° F. (−40° C.).

To ensure that the wheel 151 is engaged with the mast member 124 and to increase the torque exerted on the wheel 151 and hence the bearing 160, the spring 158 forces the wheel 151 into engagement with the mast member 124 as the arm 154 is pivoted outwardly from the bracket 152. Due to spring and space limitations and the tolerances of the components of the mast assembly 120, the spring force varies over the range of movement of the arm 154 when the mast height sensing device 150 is installed on a materials handling vehicle, such as the lift truck 100. Applicants have determined that a range of force of from about six to nine pounds over this range of movement of the arm 154 provides adequate torque for operation of the mast height sensor 150 in substantially all conditions that the lift truck 100 may be operated. When a six to nine pound range of force is used to apply the wheel 151 to the mast member 124, applicants discovered that a track 170 is formed on the mast member 124 by the knurl on the outer periphery 151A of the wheel 151 with the knurl engaging the track 170 as it rolls along the mast member 124. Formation of the track 170 can be performed by operation of the mast assembly in the factory or after the lift truck 100 is placed in service. The track 170 improves the operation of the mast height sensor 150, particularly in dry operating conditions where a rubber-like wheel can generally provide higher friction.

Figure 6:
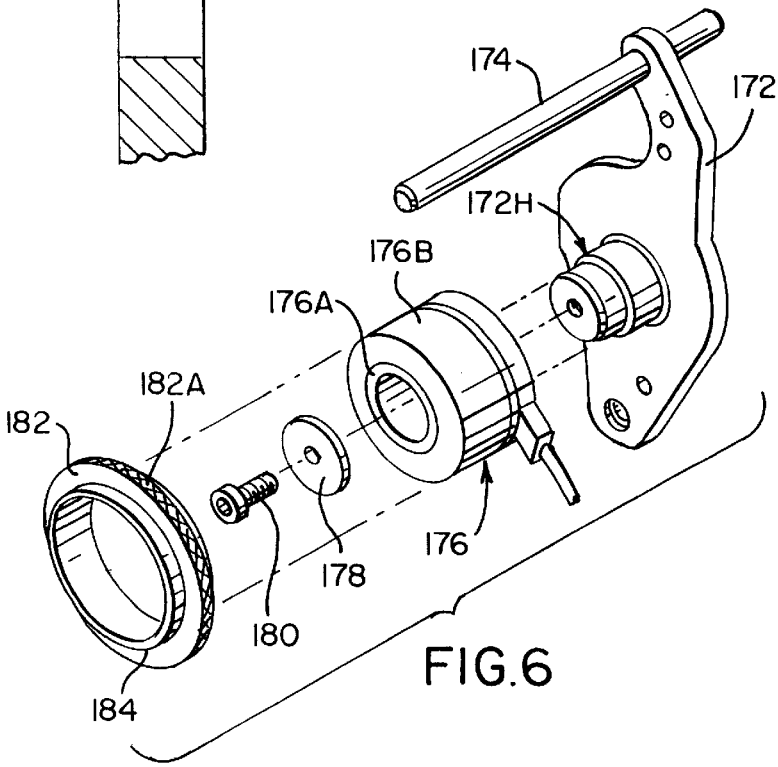
FIG. 6 is an exploded view of an alternate illustrative embodiment of the mast height sensing device showing parts of the device that are new, modified or replaced for this embodiment.

An alternate embodiment of the mast height sensor of the present application is illustrated in FIG. 6 which shows only components of the mast height sensor 150 that are new, modified or replaced in the illustrative embodiment of FIGS. 2–5. In the alternate embodiment of FIG. 6, an arm 172 is fixed to a shaft 174 that is mounted to the bracket 152 as shown in FIGS. 2–5. The arm 172 includes a stepped hub 172H that is used to fix and secure an inner race 176A of a sensor bearing 176 to the arm 172. The inner race 176A of the sensor bearing 176 is secured to the hub 172H using a washer 178 and a screw 180. An annular wheel 182 is mounted around a sleeve 184 that can be secured to the outer race 176B of the sensor bearing 176 by pressure fitting, adhesive, keying, or any other appropriate technique to prevent the wheel 182 from rotating relative to the sleeve 184. The outer periphery 182A of the wheel 182 is knurled, for example as described above relative to the wheel 151, and is then forced into engagement with a mast member, such as one of the mast members 122, 124 or 126 as was the wheel 151 of the embodiment of FIGS. 2–5. The wheel can be generally centered axially on the sleeve 184, as illustrated, or can be offset from the center. A heater (not shown) can be positioned between the inner race 176A and the portion of the hub 172H that extends into the inner race 176A for use of the mast height sensor in cold environments. Alternate heater arrangements for both of the illustrated embodiments as well other embodiments of the mast sensing device will be apparent to those skilled in the art.

While the method of sensing the height of a mast of a materials handling vehicle in accordance with the present invention should be apparent from the above description of the sensor, the method will now be briefly described for sake of clarity. In particular, a method for sensing the height of a mast of a materials handling vehicle having a mast assembly comprising at least a first mast member and a second mast member with the first mast member being moveable relative to the second mast member comprises mounting a sensor on one of the first and second mast members, coupling a knurled wheel to the sensor so that rotation of the wheel causes the sensor to generate corresponding signals, and forcing the wheel into another of the first and second mast members so that the wheel contacts the another of the first and second mast members and is rotated by the another mast member during extension and retraction of the first mast member relative to the second mast member.

Having thus described the invention of the present application in detail and by reference to preferred embodiments thereof, it will be apparent that modifications and variations are possible without departing from the scope of the invention defined in the appended claims.

What is claimed is:

1. A mast height sensing device for a materials handling vehicle having a mast assembly comprising at least a first mast member and a second mast member, said first mast member being moveable relative to said second mast member, said mast height sensing device comprising:

a sensor;

a wheel having an outer periphery that is knurled, said wheel being coupled to said sensor such that rotation of said wheel causes said sensor to generate corresponding signals; and a mount for securing said sensor to one of said first and second mast members so that said wheel is engaged with another of said first and second mast members and is rotated by extension and retraction of said first mast member relative to said second mast member.

2. A mast height sensing device as claimed in claim 1 wherein said mount includes a spring forcing said wheel into engagement with said another of said first and second mast members.

3. A mast height sensing device as claimed in claim 2 wherein a force of said spring is sufficient so that the knurl of said wheel forms a track in said another of said first and second mast members, said knurl engaging said track.

4. A mast height sensing device as claimed in claim 3 wherein said force of said spring is within a range of about six to nine pounds.

5. A mast height sensing device as claimed in claim 1 wherein said wheel has a thickness of less than about ⅛ inch.

6. A mast height sensing device as claimed in claim 5 wherein said wheel has a thickness of about 1/16 inch.

7. A mast height sensing device as claimed in claim 1 wherein said sensor comprises a shaft encoder and said wheel is connected to a shaft of said shaft encoder.

8. A mast height sensing device as claimed in claim 1 wherein:

said sensor comprises a sensor bearing; and said wheel comprises a hub extending from the center thereof, said hub being secured to an inner race of said sensor bearing for rotation.

9. A mast height sensing device as claimed in claim 8 further comprising a heating element associated with said sensor bearing.

10. A mast height sensing device as claimed in claim 1 wherein:

said sensor comprises a sensor bearing; and said wheel is mounted to an outer race of said sensor bearing.

11. A mast height sensing device as claimed in claim 10 wherein said wheel is annular and mounted over said outer race of said sensor bearing.

12. A mast height sensing device as claimed in claim 11 wherein said wheel is generally centered over said outer race of said sensor bearing.

13. A mast height sensing device for a materials handling vehicle having a mast assembly comprising at least a first mast member and a second mast member, said first mast member being moveable relative to said second mast member, said mast height sensing device comprising:

a sensor;

a wheel having a knurled outer periphery, said wheel being coupled to said sensor such that rotation of said wheel causes said sensor to generate corresponding signals; and a mount for securing said sensor to one of said first and second mast members so that said wheel is forced into another of said first and second mast members and is rotated by extension and retraction of said first mast member relative to said second mast member, said wheel being sufficiently thin that when said wheel engages ice formed on said another mast member that the ice does not build up on said knurled outer periphery of said wheel.

14. A mast height sensing device as claimed in claim 13 wherein said wheel is less than about ⅛ inch in thickness.

15. A mast height sensing device as claimed in claim 13 wherein said wheel is about 1/16 inch in thickness.

16. A mast height sensing device as claimed in claim 15 wherein said wheel is forced into said another mast member with a force of about six to nine pounds.

17. A mast height sensing device as claimed in claim 14 wherein said wheel is forced into said another mast member with a force of about six to nine pounds.

18. A mast height sensing device for a materials handling vehicle having a mast assembly comprising at least a first mast member and a second mast member, said first mast member being moveable relative to said second mast member, said mast height sensing device comprising:

a sensor;

a wheel having a knurled outer periphery, said wheel being coupled to said sensor such that rotation of said wheel causes said sensor to generate corresponding signals; and a mount for securing said sensor to one of said first and second mast members so that said wheel is forced into another of said first and second mast members and is rotated by extension and retraction of said first mast member relative to said second mast member, said wheel being forced into said another mast member with sufficient force that said wheel forms a track in said another mast member, said knurl engaging said track.

19. A mast height sensing device for a materials handling vehicle having a mast assembly comprising at least a first mast member and a second mast member, said first mast member being moveable relative to said second mast member, said mast height sensing device comprising:

a sensor;

a wheel having a knurled outer periphery, said wheel being coupled to said sensor such that rotation of said wheel causes said sensor to generate corresponding signals; and a mount for securing said sensor to one of said first and second mast members so that said wheel is forced into engagement with another of said first and second mast members and is rotated by extension and retraction of said first mast member relative to said second mast member, said wheel having a thickness of less than about ⅛ inch.

20. A method for sensing the height of a mast of a materials handling vehicle, said vehicle having a mast assembly comprising at least a first mast member and a second mast member, said first mast member being moveable relative to said second mast member, said method comprising the steps of:

mounting a sensor on one of said first and second mast members;

coupling a knurled wheel to said sensor so that rotation of said wheel causes said sensor to generate corresponding signals; and forcing said wheel into another of said first and second mast members so that said wheel contacts said another of said first and second mast members and is rotated by said another mast member during extension and retraction of said first mast member relative to said second mast member.

21. A method as claimed in claim 20 wherein said step of forcing said wheel into said another of said first and second mast members is performed with sufficient force so as to form a track on said another of said first and second mast members as said first mast member is extended and retracted relative to said second mast member.

22. A method as claimed in claim 21 wherein said track is formed during manufacture of said vehicle by extending and retracting said first mast member relative to said second mast member.

23. A method as claimed in claim 21 wherein said track is formed during normal operation of said vehicle.

24. A method as claimed in claim 20 wherein said sensor comprises a sensor bearing and said step of coupling a knurled wheel to said sensor so that rotation of said wheel causes rotation of said sensor comprises the step of:

providing a knurled wheel having a central hub; and securing said central hub to an inner race of said sensor bearing.

25. A method as claimed in claim 20 wherein said sensor comprises a sensor bearing and said step of coupling a knurled wheel to said sensor so that rotation of said wheel causes said sensor to generate corresponding signals comprises the steps of:

providing an annular knurled wheel; and securing said annular knurled wheel to an outer race of said sensor bearing.

26. A method as claimed in claim 25 wherein said step of securing said annular knurled wheel to an outer race of said sensor bearing comprises the step of securing said annular knurled wheel over said outer race of said sensor bearing.

27. A method as claimed in claim 26 further comprising the step of generally centering said knurled wheel over said outer race of said sensor bearing.

28. A method as claimed in claim 20 wherein said knurled wheel has a thickness less that about ⅛ inch.

29. A method as claimed in claim 28 wherein said knurled wheel has a thickness of about 1/16 inch.

* * * * *

UNITED STATES PATENT AND TRADEMARK OFFICE

CERTIFICATE OF CORRECTION

PATENT NO. : 6,533,076 B1
DATED : March 18, 2003
INVENTOR(S) : Haverfield et al.

It is certified that error appears in the above-identified patent and that said Letters Patent is hereby corrected as shown below:

Column 8,
Line 57, “less that about” should read -- less than about --.

Signed and Sealed this

Twenty-fourth Day of February, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,533,076 B1
DATED : March 18, 2003
INVENTOR(S) : Haverfield et al.

Figure 2:
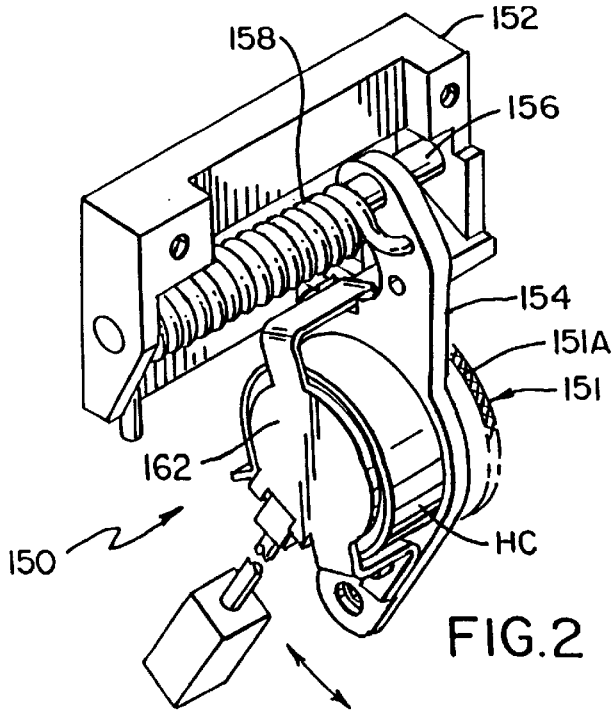
FIG. 2 is a perspective view of an illustrative embodiment of the mast height sensing device of the present application.
Figure 3:
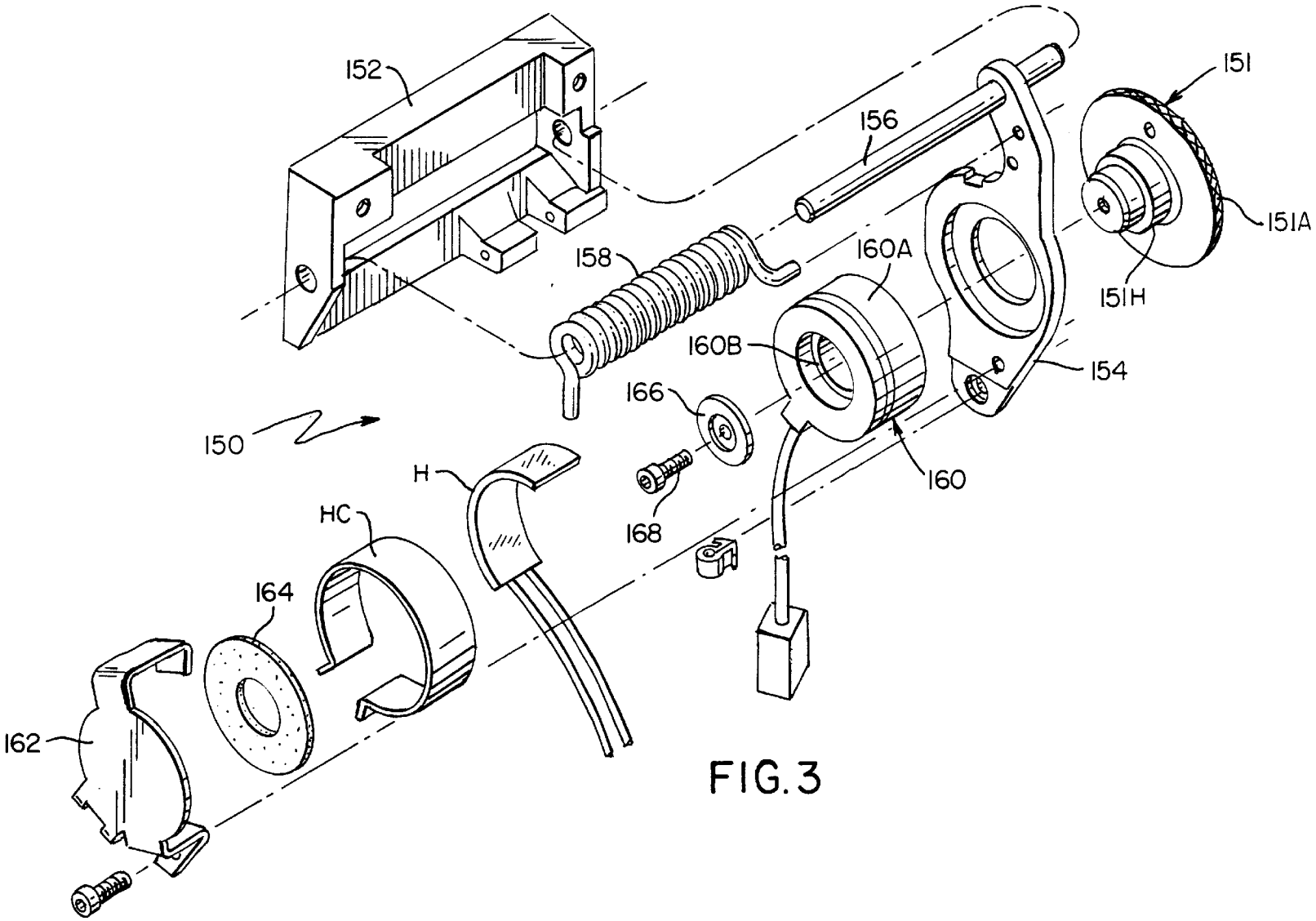
FIG. 3 is an exploded view of the mast height sensing device of FIG. 1.
Figure 4:
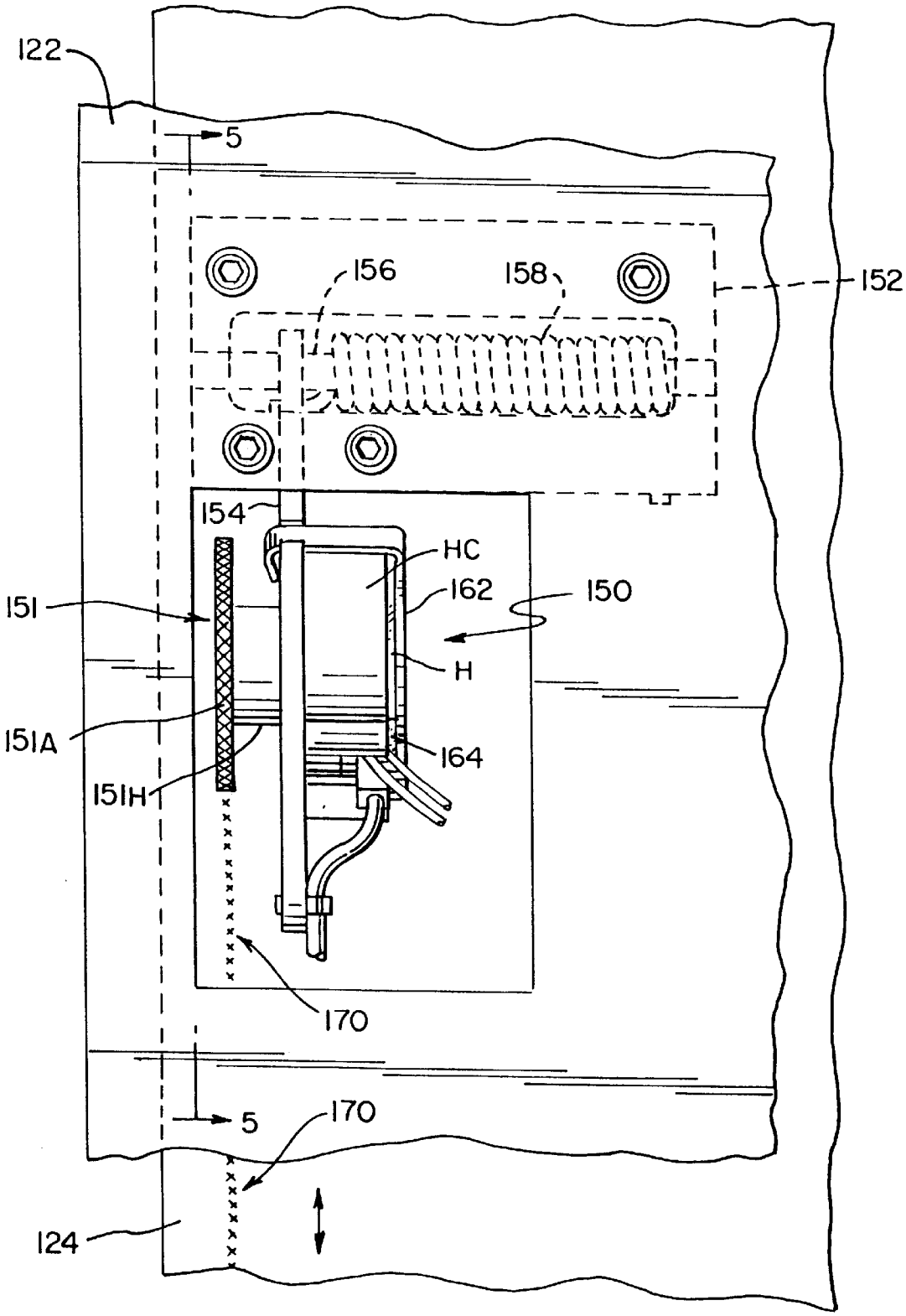
FIG. 4 is a plan view of portions of two mast members showing the mast height sensing device of FIGS. 2 and 3 mounted to one of the two mast members and a wheel of the mast height sensing device forced into engagement with another of the two mast members and engaging a track formed thereon by the wheel.
Figure 5:
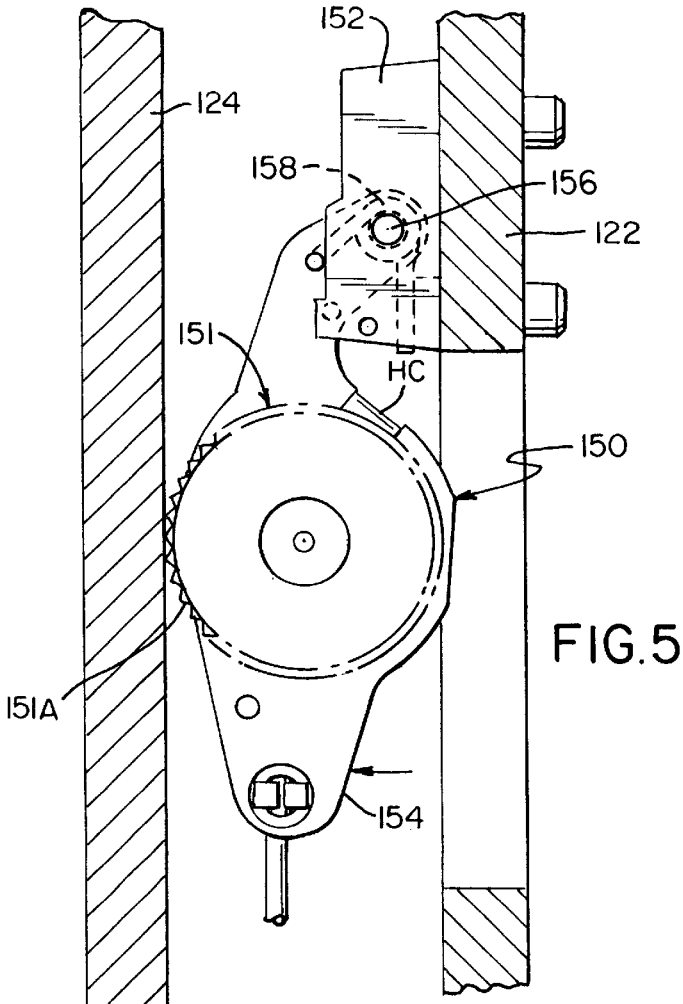
FIG. 5 is a sectional view of the mast height sensor and the two mast members of FIG. 4 taken along the section line 5—5 of FIG. 4.

It is certified that error appears in the above-identified patent and that said Letters Patent is hereby corrected as shown below:

Column 2,
Line 65, "Brief Description of the Invention" should read -- Brief Description of the Drawings --;

Column 3,
Line 4, "device of Fig. 1" should read -- device of Fig. 2 --.

Signed and Sealed this

Twentieth Day of April, 2004

JON W. DUDAS
*Acting Director of the United States Patent and Trademark Office*